US009012823B2

(12) United States Patent
Sunne et al.

(10) Patent No.: US 9,012,823 B2
(45) Date of Patent: Apr. 21, 2015

(54) VEHICLE HAVING A NANOCOMPOSITE OPTICAL CERAMIC DOME

(75) Inventors: Wayne L. Sunne, Tucson, AZ (US); Christopher E. Pentland, Vail, AZ (US); Christopher D. Marr, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 276 days.

(21) Appl. No.: 13/563,428

(22) Filed: Jul. 31, 2012

(65) Prior Publication Data

US 2014/0205370 A1 Jul. 24, 2014

(51) Int. Cl.

| | |
|---|---|
| ***F41G 7/22*** | (2006.01) |
| ***H01Q 1/42*** | (2006.01) |
| ***F42B 15/01*** | (2006.01) |
| ***F42B 10/46*** | (2006.01) |
| ***F42B 15/34*** | (2006.01) |
| *F41G 7/00* | (2006.01) |
| *H01Q 1/00* | (2006.01) |

(52) U.S. Cl.

CPC ..... *F42B 15/01* (2013.01); *F42B 10/46* (2013.01); *F42B 15/34* (2013.01)

(58) Field of Classification Search

CPC ..... F42B 10/32; F42B 10/38; F42B 10/42; F42B 10/46; F42B 15/01; F42B 15/34

USPC ..... 343/872, 873; 244/3.1–3.19; 428/357, 428/364, 34.1, 34.4; 423/1, 21.1, 263; 359/350; 252/500, 582–588; 264/1.1, 264/1.21, 1.22, 1.7, 232, 234, 235; 501/1, 501/2, 10, 94, 95.1, 95.2, 96.1, 96.5, 97.1, 501/97.2, 97.4, 98.1–98.3; 403/265, 270, 403/271, 272; 228/101, 122.1

See application file for complete search history.

(56) References Cited

U.S. PATENT DOCUMENTS

| | | | | |
|---|---|---|---|---|
| 3,898,051 | A | 8/1975 | Schmid | |
| 4,011,819 | A | 3/1977 | Kessler | |
| 4,082,427 | A | 4/1978 | Nakashima | |
| 4,291,848 | A | 9/1981 | Clark | |
| 4,304,603 | A | 12/1981 | Grossman et al. | |
| 4,347,210 | A * | 8/1982 | Maguire et al. | 264/1.21 |
| 4,575,493 | A | 3/1986 | Rauch, Sr. | |

(Continued)

FOREIGN PATENT DOCUMENTS

| | | |
|---|---|---|
| EP | 2112127 | 10/2009 |
| WO | WO 2004/051801 A1 | 6/2004 |
| WO | WO 2012/099634 | 7/2012 |

OTHER PUBLICATIONS

Stefanik et al.; Nanocomposite Optical Ceramics for Infrared Windows and Domes; Proc. of SPIE; 2007; pp. 65450A-1-65450A-5; vol. 6545.

(Continued)

*Primary Examiner* — Bernarr Gregory

(57) ABSTRACT

A vehicle, such as a missile, is disclosed. The vehicle includes an optically transparent dome, a vehicle body, and a brazed joint directly coupling the dome to the vehicle body. The dome is formed of a Nanocomposite Optical Ceramic (NCOC) material comprising two or more different types of nanograins dispersed in one another. Each nanograin type has a coefficient of thermal expansion (CTE), and an aggregate CTE of the NCOC material is based on the CTE of each nanograin type.

22 Claims, 2 Drawing Sheets

(56) References Cited

U.S. PATENT DOCUMENTS

| | | | | |
|---|---|---|---|---|
| 4,654,315 | A | 3/1987 | Hsieh | |
| 4,761,390 | A * | 8/1988 | Hartnett et al. | 264/1.22 |
| 4,930,731 | A * | 6/1990 | Roy et al. | 244/3.16 |
| 5,124,285 | A | 6/1992 | Dislich | |
| 5,358,912 | A | 10/1994 | Freitag et al. | |
| 5,573,986 | A | 11/1996 | Talmy et al. | |
| 5,677,252 | A * | 10/1997 | Gilde et al. | 501/96.5 |
| 5,702,654 | A | 12/1997 | Chen | |
| 5,775,643 | A | 7/1998 | McMaster et al. | |
| 5,941,479 | A | 8/1999 | Sunne et al. | |
| 6,341,747 | B1 | 1/2002 | Schmidt et al. | |
| 6,876,796 | B2 | 4/2005 | Garito | |
| 6,967,179 | B2 | 11/2005 | Miele et al. | |
| 7,229,600 | B2 * | 6/2007 | Yadav | 423/263 |
| 7,335,865 | B2 | 2/2008 | Tibi | |
| 7,371,702 | B2 * | 5/2008 | Ritzberger et al. | 501/10 |
| 7,498,005 | B2 * | 3/2009 | Yadav | 423/21.1 |
| 7,682,694 | B1 * | 3/2010 | Gintz et al. | 428/364 |
| 7,688,278 | B2 | 3/2010 | Frenkel | |
| 7,710,347 | B2 * | 5/2010 | Gentilman et al. | 343/872 |
| 7,749,425 | B2 * | 7/2010 | Malenfant et al. | 501/97.1 |
| 8,062,554 | B2 * | 11/2011 | Imholt et al. | 252/500 |
| 8,236,200 | B2 * | 8/2012 | Sweeney et al. | 359/350 |
| 8,445,822 | B2 * | 5/2013 | Sunne | 343/872 |
| 2001/0019651 | A1 | 9/2001 | Kato | |
| 2006/0138276 | A1 | 6/2006 | Tibi et al. | |
| 2009/0167628 | A1 | 7/2009 | Frenkel | |
| 2009/0220698 | A1 * | 9/2009 | Yadav | 252/588 |
| 2009/0283720 | A1 | 11/2009 | Sweeney et al. | |
| 2010/0105539 | A1 | 4/2010 | Hollingsworth et al. | |
| 2010/0237344 | A1 | 9/2010 | Schoenfeld | |
| 2010/0291374 | A1 | 11/2010 | Akarsu | |
| 2011/0315807 | A1 | 12/2011 | Sunne et al. | |
| 2011/0315808 | A1 * | 12/2011 | Zelinski et al. | 244/3.16 |

OTHER PUBLICATIONS

PCT Application PCT/US2011/057242; filed Oct. 21, 2011; Brian J. Zelinski; International Search Report mailed Feb. 8, 2012.

Parish; Polycrystalline Alumina for Advanced Infrared Windows and Domes; downloaded from the Internet at http://www.virtualacquistionsshowcase.com/document/1157/briefing; accessed on Jan. 21, 2011; 6 pages.

U.S. Appl. No. 13/009,837, filed Jan. 19, 2011; Brian J. Zelinski.

U.S. Appl. No. 12/821,876, filed Jun. 23, 2010; Wayne L. Sunne.

Choi, et al.; "Electrical Conductivity of Nickel Oxide-Magnesium Oxide Single Crystal"; The Journal of Physical Chemistry, vol. 77, No. 20, pp. 2430-2433; 1973.

PCT Application PCT/US2013/043425; filing date May 30, 2013; Raytheon Company; International Search Report mailed Mar. 13, 2014.

PCT Application PCT/US2011/057242; filed Oct. 21, 2011; Raytheon Company; Written Opinion of the International Searching Authority; Mailing date Feb. 8, 2012.

U.S. Appl. No. 12/821,876, filed Jun. 23, 2010; Wayne L. Sunne; Notice of Allowance mailed Jan. 30, 2013.

* cited by examiner

VEHICLE HAVING A NANOCOMPOSITE OPTICAL CERAMIC DOME

BACKGROUND

Outwardly-looking radar, infrared, and/or visible-light sensors built into vehicles such as aircraft or missiles are usually protected by a covering termed a dome. The dome serves as a window that transmits the radiation sensed by the sensor. The dome can also act as a structural element that protects the sensor and that can carry aerodynamic loadings. In many cases, the dome can protect a forward-looking sensor, wherein the dome bears large aerostructural loadings.

Where the vehicle moves relatively slowly, as in the case of helicopters, subsonic aircraft, and ground vehicles, some domes are made of nonmetallic organic materials which have good energy transmission and low signal distortion, and can support small-to-moderate structural loadings at low-to-intermediate temperatures. For those vehicles that fly much faster, such as hypersonic aircraft or missiles flying in the Mach 3-20 range, nonmetallic organic materials are inadequate for use in domes because aerodynamic friction heats the dome above the maximum operating temperature of the organic material.

In such cases, the dome is typically made of a ceramic material that can withstand elevated temperatures and that has good energy transmission characteristics. However, existing ceramics, such as sapphire, have the shortcoming that they are relatively brittle and non-elastic. The likelihood of fracture can be increased by the presence of small surface defects in the ceramic and externally imposed stresses and strains. The ceramic dome can be hermetically attached to the body of the missile, which is typically made of a metal with high-temperature strength, such as a titanium alloy.

Ceramic material has a relatively low coefficient of thermal expansion (CTE), while the metal missile body typically has a relatively high CTE. Changing the temperature of the missile body and dome can result in a CTE mismatch, which can create or induce strain between the dome and the missile body when the two are joined. This can greatly increase the propensity of the dome to fracture in a brittle manner and can lead to failure of the sensor and ultimately failure of the missile. In one typical example, the dome and the missile body are joined by brazing at approximately 1000 degrees F. At this temperature, there is effectively little to no strain in the joint due to a CTE mismatch. A temperature change can occur as the parts cool from the joining temperature. Additional temperature changes can occur, for example, when the missile is carried on board a launch aircraft or during service, in which the temperature can drop to −55 degrees F. The difference in temperature between 1000 degrees F. and −55 degrees F. can create the greatest CTE mismatch that the dome and missile body experience and, therefore, the greatest strain between the dome and the missile body. In other words, the maximum CTE mismatch stress occurs at low temperatures, when the substantially "zero stress state" at braze temperature is at its greatest difference.

To account for this CTE mismatch between the dome and missile body, some designs comprise multiple parts coupled by brazing and include transition elements to reduce the severity of CTE mismatching in stages. For example, a transition element may have an intermediate CTE relative to the dome and missile body to allow the dome to be coupled indirectly to the missile body. The result is a complex design that may also require additional aerodynamic components and sealing of joints and gaps between components, such as with polysulfide.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
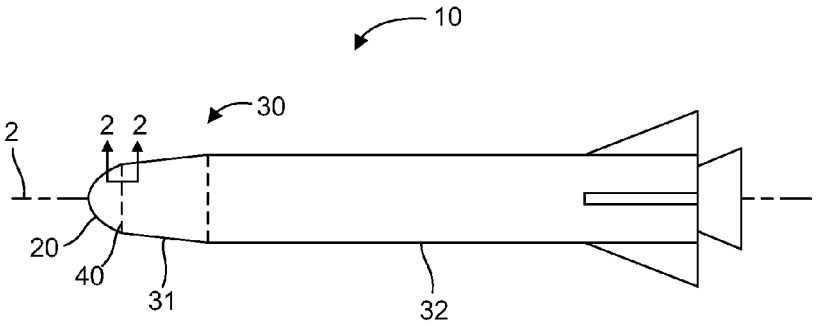
FIG. 1 is an example illustration of a missile vehicle in accordance with an embodiment of the present invention.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

An initial overview of technology embodiments is provided below and then specific technology embodiments are described in further detail later. This initial summary is intended to aid readers in understanding the technology more quickly but is not intended to identify key features or essential features of the technology nor is it intended to limit the scope of the claimed subject matter.

Although current designs and methods for coupling a ceramic dome to a missile body are serviceable, the difficulty of coupling current ceramic domes to missile bodies typically leads to a complex design with numerous parts, including polysulfide seals, which can amount to significant expense.

Additionally, regular upkeep is typically needed to maintain the integrity of polysulfide seals, which adds further to the expense and burden of the design. Thus, a simple design with a low part count and high reliability can reduce the expenses associated with manufacturing and maintaining a missile.

Accordingly, an optically transparent dome is disclosed that facilitates direct coupling to a vehicle body, which allows for a simple design with a low part count. In one aspect, a missile vehicle design is disclosed in which no seals are needed. The optically transparent dome includes an interface portion formed of a Nanocomposite Optical Ceramic (NCOC) material comprising two or more different types of nanograins dispersed in one another, each nanograin type having a coefficient of thermal expansion (CTE). An aggregate CTE of the NCOC material is based on the CTE of each nanograin type, wherein the aggregate CTE is tuned to approximate a CTE of an interface material.

In addition, a vehicle is disclosed that includes a dome formed of an NCOC material comprising two or more different types of nanograins dispersed in one another, each nanograin type having a CTE, wherein an aggregate CTE of the NCOC material is based on the CTE of each nanograin type. The vehicle also comprises a vehicle body and a brazed joint directly coupling the dome to the vehicle body. The NCOC dome material is such that thermally induced strain in the dome due to CTE differences is reduced or avoided, which obviates the need for a CTE mismatch bridge, or transition element, between the dome and the vehicle body.

One embodiment of a vehicle 10, such as a missile, is illustrated in FIG. 1. The vehicle 10 can comprise an optically transparent dome 20 and a vehicle body 30. The dome 20 can house and protect an electro-optical instrument of the missile vehicle 10 as well as provide a leading edge for the missile by covering a forward end of the vehicle body 30. The dome 20 is therefore forwardly facing as the missile flies and can be provided with a generally spherical, conical, and/or ogival shape that achieves a compromise between good aerodynamic properties and good radiation transmission properties. The missile vehicle 10 is generally cylindrical in shape about a longitudinal axis 2. In the example illustrated, the vehicle body 30 comprises a nose cone 31 and a fuselage 32. In general, a vehicle body can comprise any structure or component of a vehicle to which a dome may be coupled to or supported by. A brazed joint 40 can directly couple the dome 20 to the vehicle body 30, as discussed further herein.

The dome 20 can be formed of an NCOC material. For example, the dome 20 can be integrally-formed of an NCOC material or a solid solution-based NCOC material. Examples of suitable NCOC material for the dome 20 can be found in U.S. Pat. Application Ser. No. 12/821,876, filed Jun. 23, 2010, and entitled "One-piece Nano/Nano Class Nanocomposite Optical Ceramic (NNOC) Extended Dome having Seamless Non-complementary Geometries for Electro-optic sensors", and U.S. Pat. Application Ser. No. 13/009,837, filed Jan. 19, 2011, and entitled "Solid Solution-based Nanocomposite Optical Ceramic Materials", each of which are incorporated by reference herein in their entirety.

The NCOC material can comprise two or more different chemical phases (types of nanograins) dispersed or intermixed in one another, each phase having a sub-micron grain dimension in at least the direction approximately perpendicular to the direction of propagation of the transmitted light. All of the constituent elements of the material can have sub-micron grain dimensions, i.e., there is no host matrix. Furthermore, all of the nanograins can have a sub-micron grain dimension in the direction approximately perpendicular to the direction of propagation of the transmitted light and preferably all directions that is less than approximately one-tenth and suitably less than one-twentieth of the wavelength of transmitted light. The different nanograins can form material barriers to grain growth of the other thus strengthening the NCOC material. Because both phases of the NCOC material are nanoscale, strength reducing processing flaws commonly associated with a larger-grained matrix phase are absent. The mixture of the phases in the NCOC material can determine the dome's optical properties.

In one embodiment, the dome 20 is substantially optically transparent over a portion of the IR Band including near IR (about 0.75 to about 1.4 microns), SWIR (about 1.4 to about 3 microns), MWIR (about 3 to about 8.5 microns), LWIR (about 8 to about 12 microns), and/or the visible band (about 0.4 to about 0.75 microns). In an embodiment using a mixture of yttria (yttrium oxide, $Y_2O_3$) and magnesia (magnesium oxide, MgO), the NCOC material comprising the dome 20 transmits from 1.5 to 8.5 microns.

In general, the two or more different phases of nanograins in the NCOC can be selected from materials which are sufficiently transparent in the wavelength range of interest and can be processed to retain nanograins of submicron size in at least one direction. These materials include, but are not limited to, oxides, such as $Y_2O_3$, MgO, alumina, (aluminum oxide ($Al_2O_3$), spinel (magnesium aluminum oxide ($MgAl_2O_4$)), and non-oxides, such as carbides (e.g. silicon carbide (SiC)), oxycarbides (e.g. silicon oxycarbide ($SiO_xC_y$)), nitrides (e.g. silicon nitride ($Si_3N_4$)), oxynitrides (e.g. ($SiO_xN_y$)), borides (e.g. zirconium boride ($ZrB_2$)), oxyborides, (e.g. zirconium oxyboride ($ZO_xB_y$), sulfides, (e.g. zinc sulfide (ZnS)), selenides (e.g. zinc selenide (ZnSe)), sulfo-selenides (e.g. $ZnS_xSe_y$)), as well as semiconductors, such as silicon (Si) and germanium (Ge). In one embodiment, a LWIR application is desired, and ZnS is selected as a first phase. In one embodiment, the two phases are $Y_2O_3$ and calcium oxide (CaO).

The different phases of nanograins in a given NCOC material are mutually neutral in that they do not react chemically with each other. In one embodiment, the nanograins are selected to have similar refractive indices. In one embodiment, the difference between refractive indices of nanograins in a given NCOC material is less than about 0.25. If the disparity in refractive indices is too large, inter-particle scattering can occur, which will degrade optical performance.

In one embodiment, NCOC material can comprise approximately 50:50 by volume of $Y_2O_3$:MgO, although the NCOC material is not so limited. The relative percentages of the constituent nanograins in the NCOC material (the composition of the NCOC material) may be varied to achieve different optical properties, strength and thermal conduction. The constituent elements and/or relative percentages can vary across various regions of the dome, such as a transition between two different geometries.

An embodiment for integrally forming a one-piece NCOC dome comprises the steps of NCOC powder fabrication and preparation, near net shape forming and final shape finishing. Fabrication and preparation may use a Flame Spray Pyrolysis (FSP) to provide a precursor solution of nano-sized MgO and $Y_2O_3$. Other techniques may also be employed to provide the precursor solution, which is de-agglomerated e.g., ground and mixed with a mill, to break up any clumps. The solution is then filtered to remove impurities and any residual large particles from the solution. The solution is granulated to remove the liquid solution to form a dry powder.

Near net shape forming may be accomplished using a dry press process in which the powder is packed into a mold of the desired extended dome and pressure is applied to produce a green body of the desired near net shape. A sintering process applies heat to densify the green body. A hot isostatic press applies heat and pressure to complete densification and eliminate any remaining voids to make a fully dense dome blank.

Final shape finishing can include precision grinding and polishing of the surface of the dome to the finished shape and characterization of the dome's mechanical and optical properties to verify the dome meets the specifications.

In addition to varying the composition of the NCOC material to achieve different optical properties, strength, and thermal conduction, the composition can also be varied or tuned to achieve a desired coefficient of thermal expansion (CTE). For example, each nanograin type has a coefficient of thermal expansion (CTE). An aggregate CTE of the NCOC material can therefore be based on the CTE of each nanograin type. Thus, the NCOC dome can be "tuned" to have a CTE within a given range, which may vary according to temperature. The CTE of the NCOC dome can be tuned while also achieving suitable optical properties, strength, and thermal conduction.

Accordingly, the aggregate CTE of the NCOC dome 20 can be tuned to approximate a CTE of an interface material, such as a material of the vehicle body 30. Tuning the NCOC to approximate a CTE of the interface material can include matching CTEs, tuning to be within an acceptable range (e.g., not exactly matched), wherein the acceptable range can be based on acceptable stress and other design limits. Tuning of the CTE as discussed herein can facilitate direct brazing of the dome 20 to the vehicle body 30, which in some embodiments may comprise a nose cone 31. When the missile vehicle 10 is heated and cooled during fabrication or service, a difference in CTE between the dome 20 and the vehicle body 30 can cause the total expansion of the dome 20 and the vehicle body 30 to be different. If this difference is too great, thermally induced stresses in the dome 20 and the vehicle body 30 can result. Thermally induced stresses can cause significant damage or a reduction in failure stress in the dome 20 and/or the vehicle body 30. However, the closer the CTEs of the dome 20 and the vehicle body 30 to one another, the lower the displacement induced stresses in the joint 40 due to differential thermal expansion between the dome 20 and the vehicle body 30. Thus, in other words, and in some embodiments, the CTE of the NCOC dome 20 can be tuned such that the thermally induced strain in the dome 20 and the vehicle body 30 due to CTE differences is minimized or avoided. In one aspect, the vehicle body 30 is formed of a metallic material, such as titanium, steel, stainless steel, aluminum, or combinations thereof. The CTE of the NCOC dome can therefore be tuned to match or approximate the CTE of a given vehicle body material or combination of materials, which can obviate a need for a transition element between the dome and the vehicle body.

The relative percentages of the constituent nanograins in the NCOC material (the composition of the NCOC material) may be varied to achieve a desired CTE or a CTE within a desired range. For example, the NCOC material can comprise approximately a ratio, by volume, of $Y_2O_3$:MgO in order to tune the CTE of the NCOC material to approximate the CTE of titanium. In one exemplary embodiment, $Y_2O_3$ can comprise between about 10% and about 30% of the NCOC material by volume, and MgO can comprise between about 70% and about 90% of the NCOC material by volume. In another embodiment, $Y_2O_3$ can comprise between about 15% and about 25% of the NCOC material by volume, and MgO can comprise between about 75% and about 85% of the NCOC material by volume. In still another embodiment, $Y_2O_3$ can comprise about 20% of the NCOC material by volume, and MgO can comprise about 80% of the NCOC material by volume. Other compositions or ratios of the NCOC material may be utilized to approximate or match a CTE of another material.

As alluded to, in many cases, an exact match of CTEs is not feasible or necessary to maintain thermally induced stresses within acceptable or even desired limits. Moreover, tuning of the CTE may be limited by overriding concerns such as optical properties, strength, and/or thermal conductivity, for example. Thus, in one aspect, the aggregate CTE of the NCOC material can be approximated to be within a given range of a CTE of a material of the vehicle body that is within a given temperature range. For example, and not to be construed as limiting in any way, the aggregate CTE of the NCOC material can be within about 5%-15% of a CTE of a material of the vehicle body 30 at a reference temperature between −50 and −60 degrees F. in order to maintain thermal stresses within acceptable limits. In another example, the aggregate CTE of the NCOC material can be within about 10% of a CTE of a material of the vehicle body 30 at a reference temperature of −55 degrees F. in order to maintain thermal stresses within acceptable limits.

The reference temperature can be any suitable temperature at which a comparison of CTEs is made, and the difference in CTEs between the NCOC dome material and the material of the vehicle body at the reference temperature can be correlated to an acceptable stress level of the dome 20 and the vehicle body 30. In one non-limiting example, using a reference temperature of −55 degrees F., the resulting stress in the dome 20 and the vehicle body 30 due to a CTE mismatch resulting from the difference in the joining temperature (i.e. 1000 degrees F.) and a cold temperature limit (i.e. a reference temperature of −55 degrees F.) can be compared to the material strengths of the dome 20 and the vehicle body 20 to determine whether the CTE mismatch will induce stresses that cause failure of one or both of the parts in the joint. The difference in CTEs between the NCOC dome material and the material of the vehicle body at any reference temperature, such as at the greatest temperature differential between the braze or joining temperature and a maximum cold temperature or a cold temperature limit, for example, can therefore be correlated to an acceptable stress level of the dome 20 and the vehicle body 30. If the CTE mismatch is too great at a given reference temperature, the integrity of the NCOC dome and/or the vehicle body can be adversely affected due to the levels of stress induced. For example, a CTE mismatch that is too great can cause the NCOC dome to break or otherwise fail.

Figure 2:
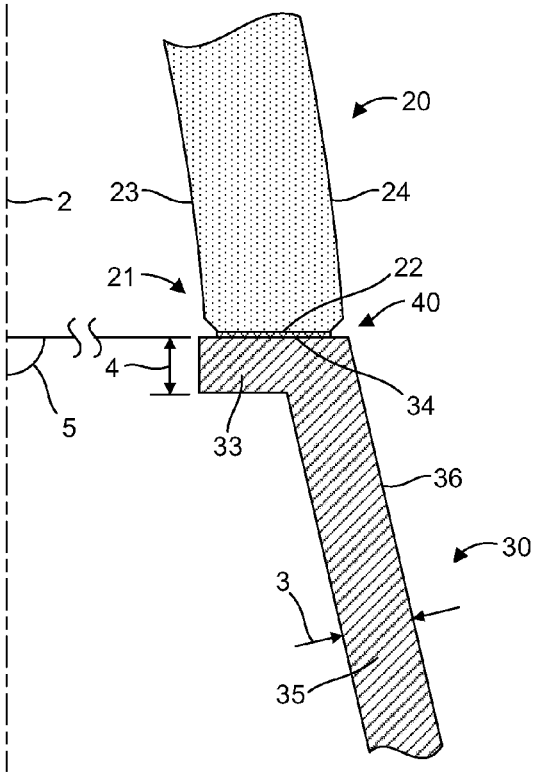
FIG. 2 is a cross-sectional view of a joint coupling an optically transparent dome to a body of the missile vehicle of FIG. 1.

FIG. 2 illustrates a cross-section of a region at a forward end of the missile vehicle 10 in FIG. 1, where the dome 20 is coupled to the vehicle body 30 at the joint 40. For clarity, additional surrounding structure is not shown, however, the missile vehicle 10 is generally cylindrical in shape. The dome 20 can include an interface portion 21 for interfacing and coupling with the vehicle body 30. For example, the interface portion 21 can include an interface surface 22 configured to interface with and couple directly to the vehicle body 30, such as to a support flange 33.

The tuned CTE of the NCOC dome 20 can facilitate direct brazing of the interface portion 21 to the vehicle body 30. In one exemplary embodiment, the joint 40 can comprise a brazed butt joint between the interface surface 22 and a dome interface 34 of the support flange 33. Any suitable brazing alloy can be used. For example, the joint 40 can be formed using an active brazing alloy that chemically reacts with the material of the dome 20 during the brazing operation. In one exemplary embodiment, the brazing material for brazing the dome 20 to the vehicle body 30 can comprise Incusil ABA, Incusil-15, or equivalent. Incusil-15 and Incusil ABA are registered tradenames of WESGO Inc. Incusil ABA is an active braze alloy having a composition, in weight percent, of about 27.25 percent copper, about 12.5 percent indium, about 1.25 percent titanium, and the balance silver, while Incusil-15 has essentially the same composition as Incusil ABA, less the titanium. Both alloys have a braze temperature of about 1300 F.

In one aspect, the CTE of the NCOC dome material can be caused to approximate or match a CTE (the term "match" including the CTE being within an acceptable range as discussed above) of the vehicle body material across a temperature range defined by a minimum temperature likely to be experienced by the dome 20 and the vehicle body 30 and the maximum brazing temperature. This can ensure that any CTE mismatches that may occur over this range will be accounted for and that resulting stresses will not exceed design limits.

In one embodiment, the braze alloy can be provided in the form of a braze alloy disk that is placed between the interface surface 22 and the dome interface 34 of the support flange 33. The brazing is accomplished by heating the dome 20 and the vehicle body 30, with the braze alloy washer therebetween, to a brazing temperature sufficient to melt the braze alloy and cause it to flow freely, (e.g., at about 1330 F). The brazing is accomplished in a vacuum of about $8\times10^{-5}$ Torr or less and with a temperature cycle involving a ramping up from room temperature to the brazing temperature of about 1300 F, a hold at the brazing temperature for 9 minutes, and a ramping down to ambient temperature, the total cycle time being about 5 hours. A flat braze alloy disk can prevent the braze alloy from contacting the inside surface 23 or the outside surface 24 of the dome 20. The volume of the braze alloy disk can be chosen so that, upon melting, the braze material just fills the region between the interface surface 22 and the dome interface 34, such that there is no excess braze alloy to flow onto the inside and outside surfaces 23, 24.

Additionally, the joint 40 may be hermetic, if desired, so that delicate sensors within the dome can be protected against external environmental influences, as well as aerodynamic and aerothermal loadings. The hermetic seal prevents atmospheric contaminants from penetrating into the interior of the vehicle body 30 during storage. It also prevents gasses and particulate material from penetrating into the interior of the vehicle body 30 during service. Any operable joint structure and joining technique may be used.

As further illustrated in FIG. 2, the vehicle body 30 can include a side wall 35 having an exterior surface 36 and a thickness 3. The support flange 33 can extend inwardly from the exterior surface 36 and can have a thickness 4. The dome interface 34 of the support flange 33 can be at dome interface angle 5 relative to the longitudinal axis 2 of the vehicle 10. In one aspect, the dome interface 34 is generally perpendicular, or substantially 90 degrees, to the longitudinal axis 2. It should be recognized, in accordance with the present disclosure, that the side wall thickness 3, the support flange thickness 4, and the dome interface angle 5 can be varied to achieve a desired result, as discussed herein. In one aspect, the exterior surface 36 comprises an aerodynamic surface. Thus, the exterior surface 36 can provide structural as well as aerodynamic functions. This can obviate a need for a separate aerodynamic skirt about the joint. With an NCOC dome having a CTE tuned for direct coupling to a vehicle body, the resulting design for coupling the dome and the vehicle body can therefore be a simple brazed joint of two components, without a need for transition elements or additional components that may result from coupling parts having two very different CTEs.

In addition, with no separate aerodynamic skirt and because the joint 40 can be hermetically sealed, the need for a polysulfide or other similar type of seal is obviated. However, it should be recognized, that a sealing material may be used to simply cover any exposed portion of the braze alloy to prevent or minimize corrosion of the exposed braze alloy. In such cases a durable seal material can be used that requires little or no maintenance.

Figure 3:
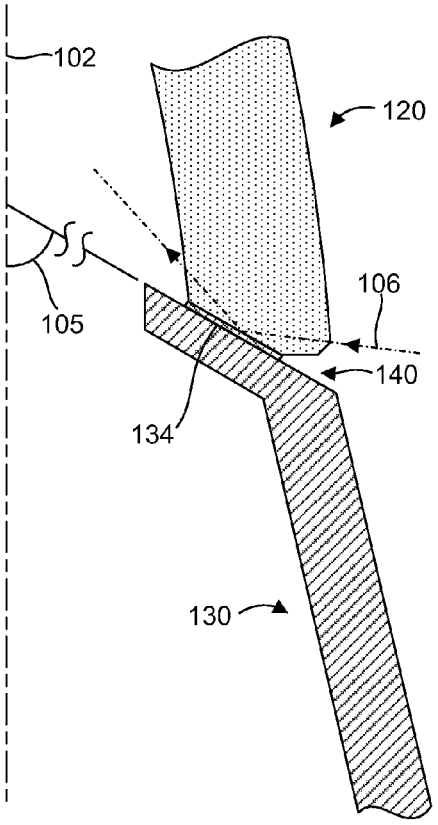
FIG. 3 is a cross-sectional view of a joint coupling an optically transparent dome to a body of a vehicle in accordance with another embodiment of the present invention.

Referring to FIG. 3, an embodiment of a vehicle body 130 is illustrated in which a dome interface angle 105 can be configured to prevent unwanted light from interfering with sensitive electro-optical instruments disposed in a dome 120. In particular, light 106 can reflect off the braze alloy of the joint 140 and enter the interior of the dome 120 where it can interfere with the electro-optical instruments disposed inside. The angle 105 can be adjusted such that light 106 is reflected or diverted off the braze alloy of the joint 140, such that the sensitive instruments remain unaffected. The dome interface surface 134 can therefore be configured to perform the additional function of a stray light shield.

Figure 4:
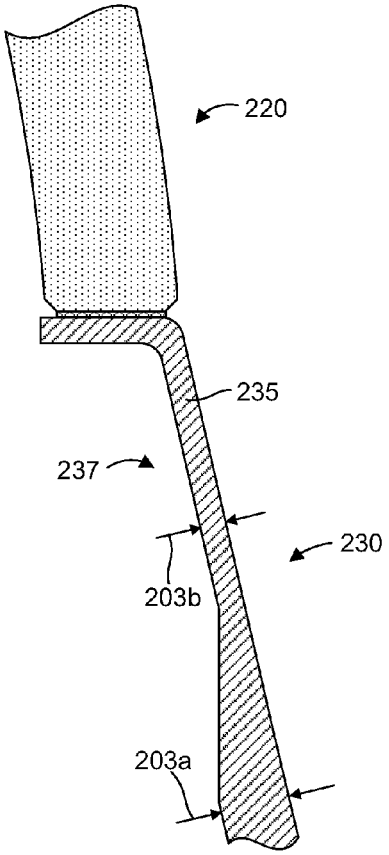
FIG. 4 is a cross-sectional view of a joint coupling an optically transparent dome to a body of a vehicle in accordance with yet another embodiment of the present invention.

FIG. 4 illustrates an embodiment of a vehicle body 230 comprising a flexure region 237 of a side wall 235 having a reduced area to facilitate flexure of the vehicle body 230 in order to relieve stress in a vehicle. For example, the side wall 235 can be thinned (or comprise a reduced cross-sectional area) (see relative wall thicknesses 203*a* and 203*b*) near the area of attachment of the dome 220 to provide local flexure in the vehicle body 230. Stated alternatively, the thermally induced stresses can be introduced into the flexure region 237 of the vehicle body 230 and not into the dome 220. This can be done in the event that CTEs of the NCOC dome 220 and the vehicle body 230 are not sufficiently matched at a given temperature to maintain thermally induced stresses within acceptable limits due to the difference in CTEs between the dome material and the vehicle body material. Thus, in addition to the tuned CTE of the NCOC dome, the flexure region 237 can also serve to avoid or minimize thermally induced stresses. In one aspect, the flexure region 237 can also form an exterior aerodynamic surface of the vehicle body 230.

Figure 5:
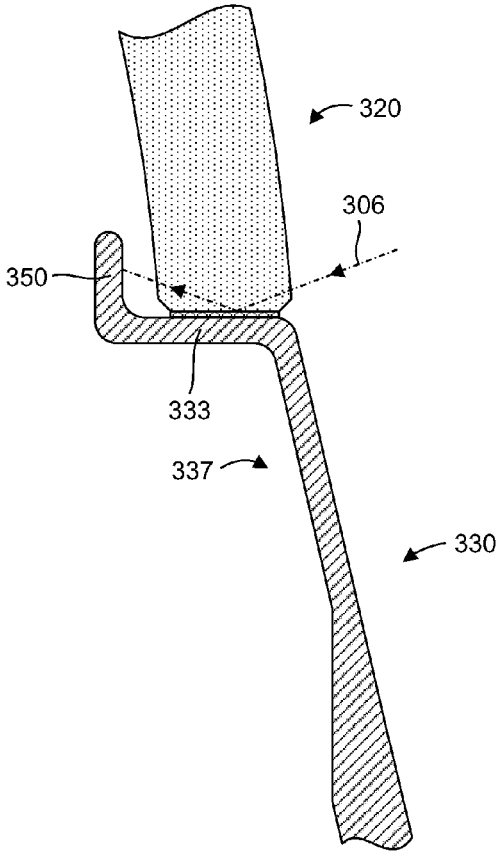
FIG. 5 is a cross-sectional view of a joint coupling an optically transparent dome to a body of a vehicle in accordance with still another embodiment of the present invention.

FIG. 5 illustrates another embodiment of a vehicle body 330 comprising a stray light shield 350 extending from the support flange 333. The stray light shield 350 is configured to block light 306 from reflecting off the braze alloy of the brazed joint 340 and into an interior region of the dome 320. In one aspect, the stray light shield 350 can comprise a rim extending from the support flange 333. The rim can also serve to provide stiffness for the vehicle body 330, which can offset, at least to a certain extent, stiffness sacrificed for a thin flexure region 337 without negating the benefits of the flexure region 337, as discussed herein. The stray light shield 350 can extend at any angle and can be of any suitable configuration to provide a physical barrier to block light 306 reflected from the braze alloy of the joint 340. It should be recognized that a stray light shield 350 can also be utilized in conjunction with an angled dome interface to prevent unwanted reflected light from interfering with an instrument inside the dome 320, as discussed herein with reference to FIG. 3.

In accordance with one embodiment of the present invention, a method for coupling a dome to a vehicle body is disclosed. The method can comprise obtaining a metallic vehicle body. The method can further comprise obtaining a dome formed of a Nanocomposite Optical Ceramic (NCOC) material comprising two or more different types of nanograins dispersed in one another, each type having a coefficient of thermal expansion (CTE), wherein an aggregate CTE of the NCOC material is based on the CTE of each nanograin type. Additionally, the method can comprise brazing the dome directly to the vehicle body. It is noted that no specific order is required in this method, though generally in one embodiment, these method steps can be carried out sequentially.

In one aspect, the NCOC material comprises a MgO type of nanograin and a $Y_2O_3$ type of nanograin. In another aspect, the method can further comprise specifying the aggregate CTE of the NCOC to approximate a CTE of the metallic vehicle body, or to fall within an acceptable or even a desired range relative to a CTE of the metallic vehicle body. Such an acceptable or desired range can include that in which resulting stresses, if any, in the dome and the vehicle body are within acceptable design limits.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

Furthermore, the described features, structures, or characteristics may be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. An optically transparent dome, comprising:

an interface portion formed of a Nanocomposite Optical Ceramic (NCOC) material comprising two or more different types of nanograins dispersed in one another in select proportions, each nanograin type having a coefficient of thermal expansion (CTE); and an aggregate CTE of the NCOC material based on the CTE of each nanograin type, wherein the proportions of each nanograin type are selected such that the aggregate CTE approximates a CTE of a material of a component that interfaces with the interface portion.

2. The dome of claim 1, wherein the component that interfaces with the interface portion comprises a vehicle body and the aggregate CTE is configured to facilitate direct brazing of the interface portion to the vehicle body.

3. The dome of claim 2, wherein the vehicle body is formed of titanium, steel, stainless steel, aluminum, or combinations thereof.

4. The dome of claim 1, wherein the NCOC material comprises a MgO type of nanograin and a Y2O3 type of nanograin.

5. The dome of claim 1, wherein the aggregate CTE is configured to match the CTE of the material of the component that interfaces with the interface portion.

6. The dome of claim 1, wherein the aggregate CTE is configured to be within a given range based on acceptable stress limits.

7. A vehicle comprising:

an optically transparent dome formed of a Nanocomposite Optical Ceramic (NCOC) material comprising two or more different types of nanograins dispersed in one another, each nanograin type having a coefficient of thermal expansion (CTE), wherein an aggregate CTE of the NCOC material is based on the CTE of each nanograin type;

a vehicle body; and a brazed joint directly coupling the dome to the vehicle body.

8. The vehicle of claim 7, wherein the NCOC material comprises a MgO type of nanograin and a Y2O 3 type of nanograin.

9. The vehicle of claim 7, wherein the aggregate CTE of the NCOC material is within about 10% of a CTE of a material of the vehicle body at −55 degrees F.

10. The vehicle of claim 9, wherein the material of the vehicle body comprises titanium, steel, stainless steel, aluminum, or combinations thereof.

11. The vehicle of claim 7, wherein the vehicle body comprises a nose cone of a missile.

12. The vehicle of claim 7, wherein the vehicle body comprises a support flange having a dome interface to couple with the dome.

13. The vehicle of claim 12, wherein the support flange extends inwardly from an exterior surface of the vehicle body.

14. The vehicle of claim 12, wherein the dome interface is at an angle relative to a longitudinal axis of the vehicle.

15. The vehicle of claim 14, wherein the angle is substantially 90 degrees.

16. The vehicle of claim 12, further comprising a stray light shield extending from the support flange to block light from reflecting off the brazed joint and into an interior region of the dome.

17. The vehicle of claim 16, wherein the stray light shield comprises a rim extending from the support flange.

18. The vehicle of claim 7, wherein the vehicle body comprises a flexure region having a reduced area to facilitate flexure of the vehicle body in order to relieve stress in the vehicle.

19. The vehicle of claim 18, wherein the flexure region forms an exterior aerodynamic surface of the vehicle body.

20. A method for coupling a dome to a vehicle body, comprising:

obtaining a metallic vehicle body;

obtaining an optically transparent dome formed of a Nanocomposite Optical Ceramic (NCOC) material comprising two or more different types of nanograins dispersed in one another, each nanograin type having a coefficient of thermal expansion (CTE), wherein an aggregate CTE of the NCOC material is based on the CTE of each nanograin type; and brazing the dome directly to the vehicle body.

21. The method of claim 20, wherein the NCOC material comprises a MgO type of nanograin and a Y2O3 type of nanograin.

22. The method of claim 20, further comprising specifying the aggregate CTE of the NCOC to approximate a CTE of the metallic vehicle body.

* * * * *